US005354046A

United States Patent [19]

Hattori

[11] Patent Number: 5,354,046

[45] Date of Patent: Oct. 11, 1994

[54] PAPER STACKING APPARATUS FOR SHEET-FED PRESS

[75] Inventor: Hirotaka Hattori, Ibaragi, Japan

[73] Assignee: Komori Corporation, Tokyo, Japan

[21] Appl. No.: 142,788

[22] Filed: Oct. 25, 1993

[30] Foreign Application Priority Data

Oct. 26, 1992 [JP] Japan ..... 4-079938

[51] Int. Cl.[5] ..... B65H 1/14

[52] U.S. Cl. ..... 271/147; 271/164; 271/213

[58] Field of Search ..... 271/146, 147, 148, 162, 271/164, 213, 221, 222

[56] References Cited

U.S. PATENT DOCUMENTS

| | | | |
|---|---|---|---|
| 808,019 | 12/1905 | Cross | 271/164 |
| 2,184,296 | 12/1939 | Goebel et al. | 271/31 |
| 4,697,804 | 10/1987 | Pollich | 271/162 |
| 4,703,924 | 11/1987 | Marass | 271/162 X |

FOREIGN PATENT DOCUMENTS

1109020[U] 2/1989 Japan .

1-109020 7/1989 Japan .

*Primary Examiner*—Richard A. Schacher

*Attorney, Agent, or Firm*—Blakely, Sokoloff, Taylor & Zafman

[57] ABSTRACT

A paper stacking apparatus for a sheet-fed press includes a horizontal lower plate, a driving unit, a vertical chain, an upper plate, a front gauge, biasing members, a cam, and engaging members. The lower plate is free to move in a vertical direction. The driving unit and the vertical chain vertically move the lower plate. The upper plate is mounted on the lower plate to be movable in at least a paper feed direction and stacks paper sheets. The front gauge is vertically fixed on a machine frame and aligns the leading end of the paper sheets stacked on the upper plate in the paper feed direction. The biasing members bias two side portions of the upper plate in a direction to be pressed to the front gauge. The cam and the engaging members position the upper plate biased by the biasing members in the paper feed direction such that the distal end thereof is close to the front gauge in accordance with an upward movement of the lower plate.

11 Claims, 3 Drawing Sheets

PAPER STACKING APPARATUS FOR SHEET-FED PRESS

BACKGROUND OF THE INVENTION

The present invention relates to a paper stacking apparatus for a sheet-fed press, which stacks, on the paper stack plate of a paper feed apparatus, paper sheets to be supplied to a printing unit.

FIG. 3 shows a paper stacking apparatus of this type proposed by the present applicant and disclosed in Japanese Utility Model Laid-Open No. 1-109020, in which the front portion of the paper stacking apparatus in the feed direction to a printing unit is the left side of the drawing. Referring to FIG. 3, a pair of left and right elevating bars 3 are respectively hung by elevating chains 2 from a pair of left and right paper feed frames 1 each formed in an inverted L-shape when viewed from the side surface. When the elevating chains 2 are wound up or rewound by driving units (neither are shown) to cause projections 6 to engage with grooves 4*a* of guide support columns 4, respectively, and at the same time, rollers 9 supported on the elevating bars 3 through brackets 7 and arms 8 are respectively engaged with grooves 5*a* of guide support columns 5 to vertically move the elevating bars 3.

Each roller 9 is biased by a compression coil spring 11 interposed between the swingable arm 8 and a spring seat 10 standing on each elevating bar 3 in a direction to be pressed against the corresponding groove 5*a*. More specifically, when the roller 9 is pressed against the groove 5*a* by the biasing force of the compression coil spring 11, the elevating bar 3 is biased forward, i.e., to the guide support column 4 side by the reactive force.

On the other hand, cams 12 each having an inclined surface 12*a* are fixed on the base end faces of the frames 1 close to the left and right elevating bars 3. Rollers 13 pivotally mounted on the elevating bars 3 are pressed against the inclined surfaces 12*a* by the biasing forces of the compression coil springs 11, respectively.

A pair of bars 14 are integrally supported on the front and rear portions of each of the left and right elevating bars 3. A rectangular paper stack plate 16 on which paper sheets 15 are stacked is mounted on the pair of bars 14. A plurality of vertical front gauges 17 are disposed in front of the paper stack plate 16. The paper sheets 15 are stacked while the leading ends thereof are kept in contact with the front gauges 17, thereby aligning the leading and trailing ends of the paper sheets 15.

With the above arrangement, when the elevating chains 2 are rewound to cause the elevating bars 3 to move downward to the lower limit before the printing operation, the rollers 13 are moved from the lower portions of the inclined surfaces 12*a* to the higher portions. The elevating bars 3 are thus moved backward, i.e., toward the guide support columns 5 sides against the biasing forces of the compression coil springs 11.

After stacking the paper sheets 15 on the paper stack plate 16 outside the machine frame, the paper stack plate 16 is conveyed onto the bars 14 integral with the elevating bars 3 by a handlift or the like. At this time, the leading ends of the paper sheets 15 are brought into contact with the front gauges 17 and aligned. Since the elevating bars 3 are pressed by the cams 12, and the rollers 9 are pressed against the grooves 5*a* while compressing the compression coil springs 11, the elevating bars 3 are stable to prevent the paper sheets from fluttering.

When the printing operation is started after stacking the paper sheets 15, the paper sheets 15 are drawn one by one by a sucker apparatus (not shown) and supplied to the printing unit, thereby performing printing. In accordance with paper feeding, the elevating chains 2 are intermittently wound up to cause the elevating bars 3 to move upward. At this time, the roller 13 are released from the pressures at the higher portions of the inclined surfaces 12*a* of the cams 12. The elevating bars 3 are moved forward by the biasing forces of the compression coil springs 11.

The leading ends of the paper sheets 15 integral with the elevating bars 3 through the paper stack plate 16 are pressed against the front gauges 17 and aligned. Even after the elevating bars 3 are moved further upward to keep the rollers 13 away from the cams 12, the paper sheets 15 are pressed against the front gauges 17 by the biasing forces of the compression coil springs 11, and movements in the left and right directions are regulated by the guide support columns 4 and 5. Therefore, the paper sheets 15 do not flutter even when they are hung by the elevating chains 2.

As described above, in the conventional paper stacking apparatus, the paper sheets 15 stacked on the paper stack plate 16 are stable. However, when the paper stack plate 16 on which the paper sheets 16 are stacked is conveyed onto the bars 14 by a forklift or the like, if the left and right sides of the paper sheets 15 stacked on the paper stack table outside the machine frame are not aligned and the paper sheets 15 are skewed, the entire paper sheets 15 are not uniformly brought into contact with the front gauges 17, and sometimes, some of the paper sheets 17 are not in contact with the front gauges 17. If the printing operation is started in this situation, the paper sheets 15 clog during conveyance to cause an increase in waste paper, or a printing trouble is caused to degrade the quality of printed matter. In addition, since much time is required to correct the skew of the paper sheets 15, the preparation time is prolonged to degrade the operating ratio of the printing press.

SUMMARY OF THE INVENTION

It is an object of the present invention to provide a paper stacking apparatus for a sheet-fed press, which can uniformly press the leading ends of stacked paper sheets against front gauges within a short period of time.

In order to achieve the above object, there is provided a paper stacking apparatus for a sheet-fed press, comprising a horizontal lower plate free to move in a vertical direction, driving means for vertically moving the lower plate, an upper plate, mounted on the lower plate to be movable in at least a paper feed direction, for stacking paper sheets, a front gauge, vertically fixed on a machine frame, for aligning leading end of the paper sheets stacked on the upper plate in the paper feed direction, biasing members for biasing two side portions of the upper plate in a direction to be pressed to the front gauge, and positioning means for positioning the upper plate biased by the biasing members in the paper feed direction such that a distal end thereof is close to the front gauge in accordance with an upward movement of the lower plate.

DESCRIPTION OF THE PREFERRED EMBODIMENT

Figure 1:
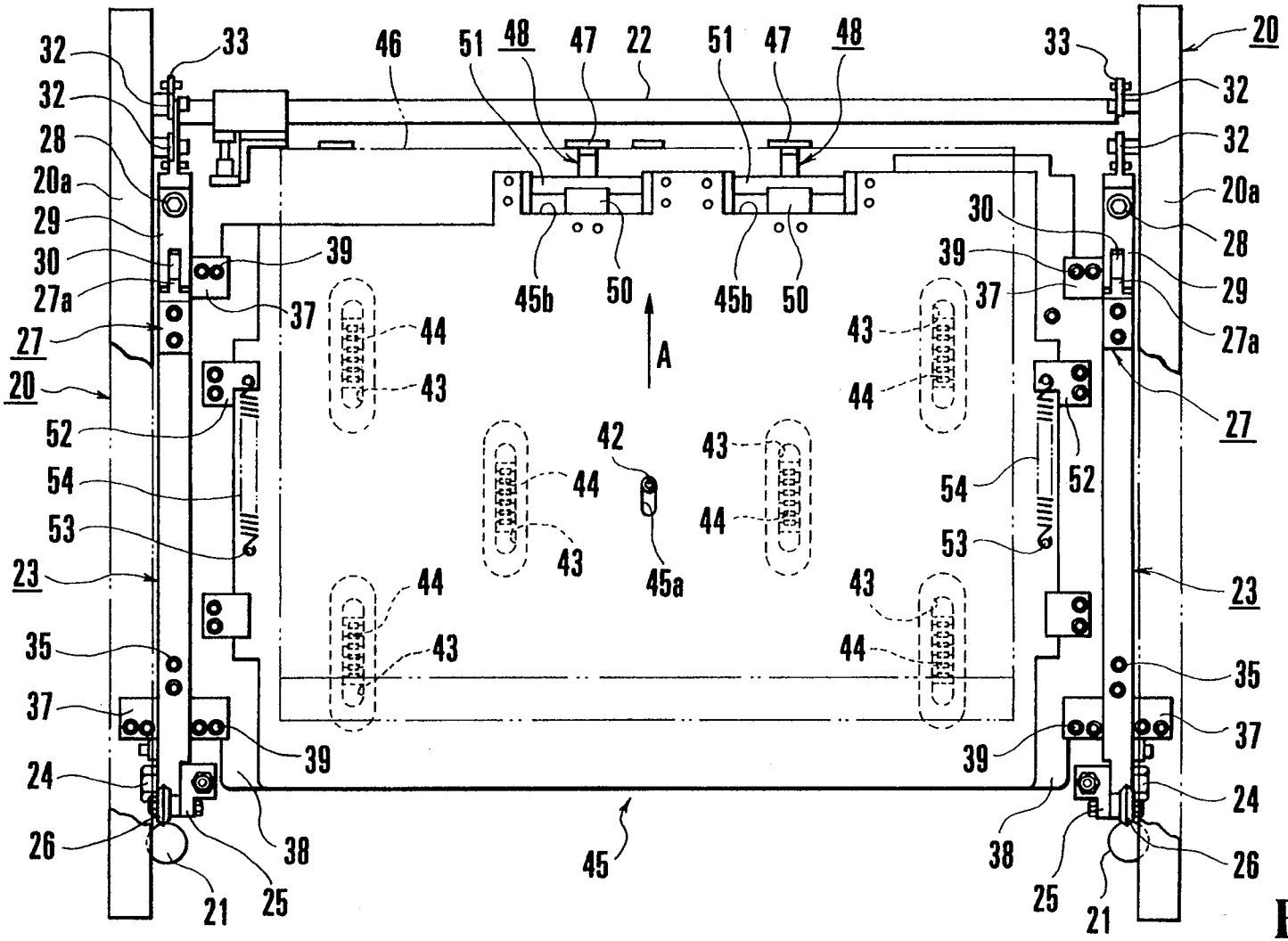
FIG. 1 is a plan view showing a paper stacking apparatus.
Figure 2:
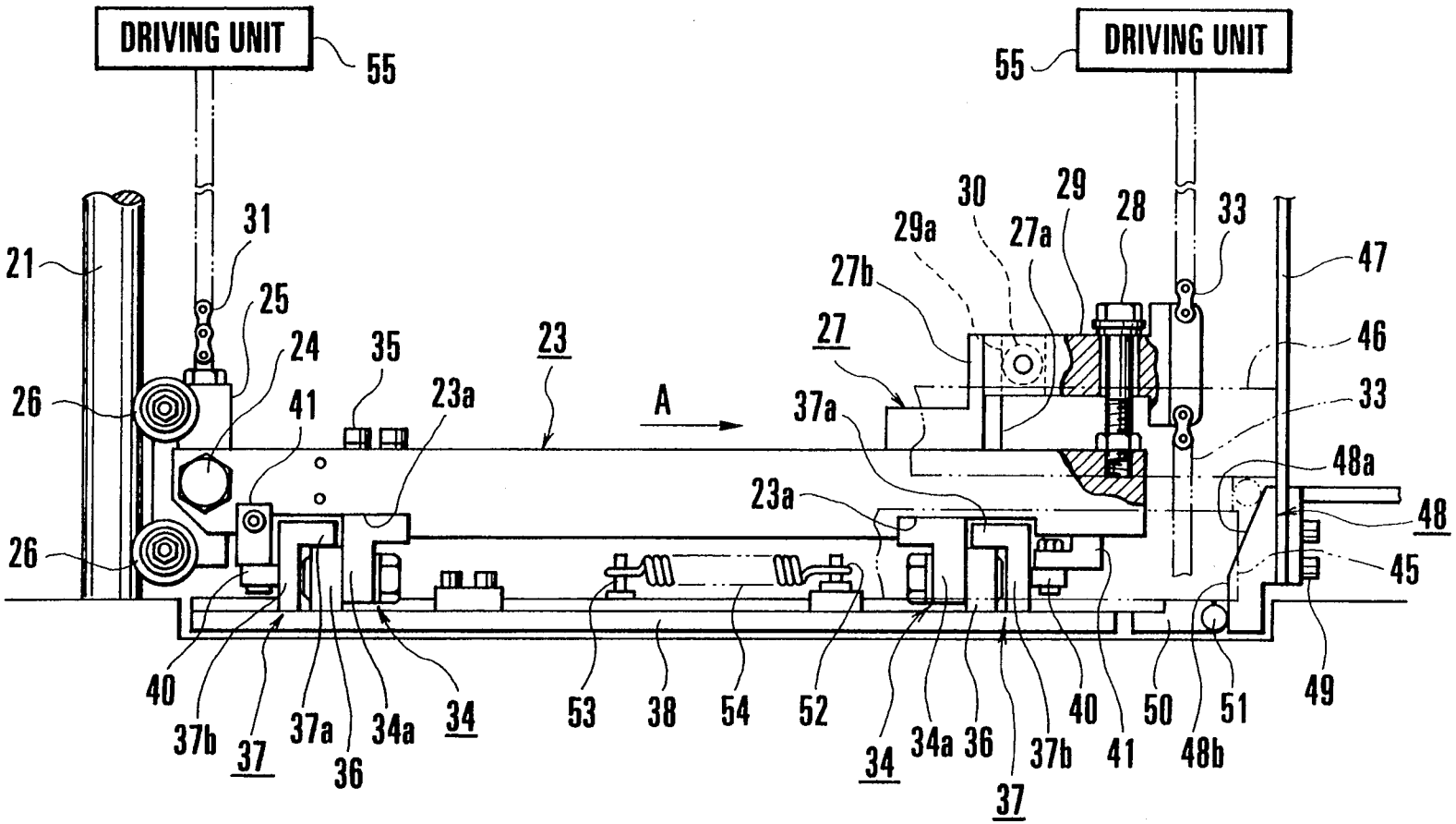
FIG. 2 is a side view showing the paper stacking apparatus.
Figure 3:
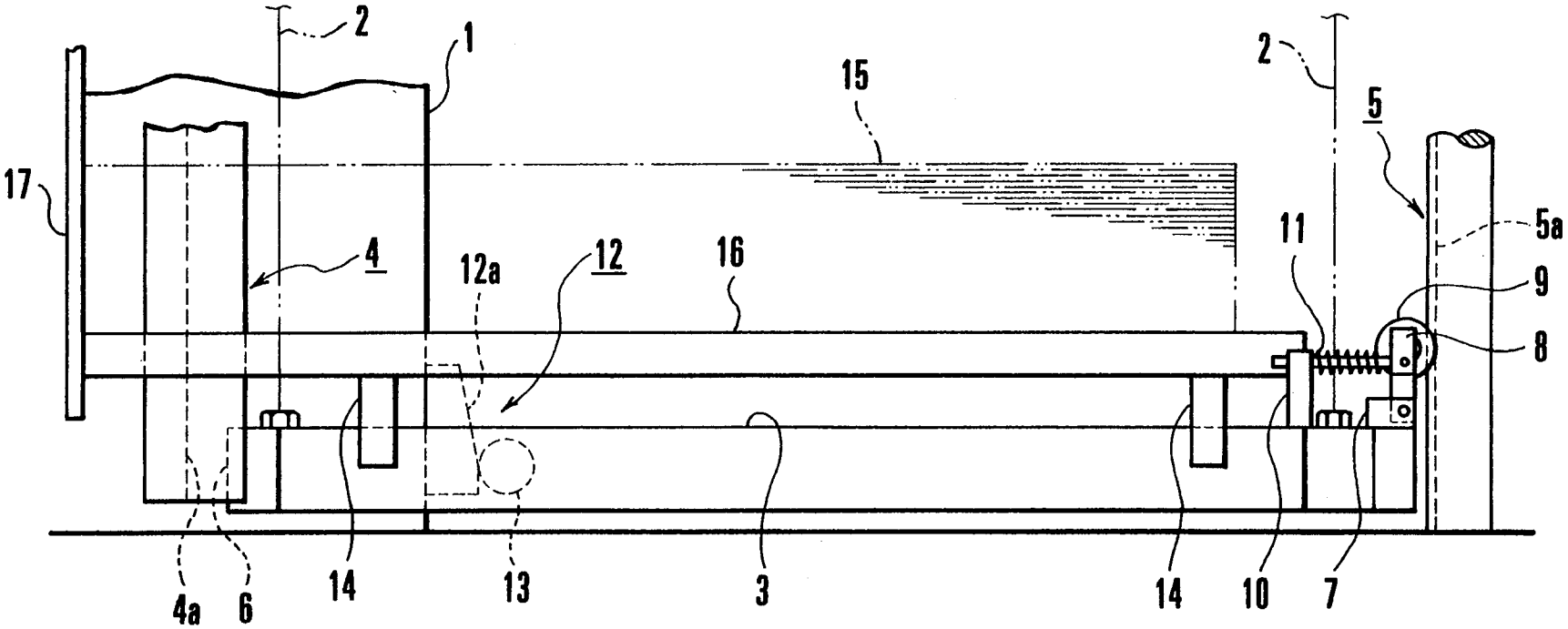
FIG.3 PRIOR ART
FIG. 3 is a side view showing a conventional paper stacking apparatus.

FIGS. 1 and 2 show a paper stacking apparatus for a sheet-fed press according to an embodiment of the present invention, in which the front portion of the paper stacking apparatus in the feed direction to a printing unit is the upper side of FIG. 1 and the right side of FIG. 2. Referring to FIGS. 1 and 2, a pair of left and right paper feed frames 20 are formed in an inverted L-shape when viewed from the side surface and have the lower ends of the vertical members in contact with the floor surface. Columnar support columns 21 are in contact with the vertical members of the paper feed frames 20, respectively, and stand on the floor surface. Horizontal members 20*a* are bent in the horizontal direction such that the upper portions of the pair of the paper feed frames 20 oppose each other. The distal end portions of the horizontal members 20*a* are coupled to each other by a stay 22 at the front portion of the apparatus.

A pair of left and right elevating bars 23 are formed in a long plate-like shape along the left and right paper feed frames 20. Brackets 25 are fixed to the rear end portions of the elevating bars 23 by bolts 24, respectively. A pair of upper and lower rollers 26 engaged with one of the support columns 21 to be vertically movable are pivotally mounted on each bracket 25.

L-shaped brackets 27 each having a projection 27*a* vertically formed on the front portion of a vertical portion 27*b* are fixed by bolts on the front-side upper surfaces of the left and right elevating bars 23, respectively. Bolts 28 located in front of the brackets 27 stand upward from the upper surfaces of the elevating bars 23, respectively. Sliding metal pieces 29 each having a groove 29*a* formed at the rear end portion and slidably engaged with the projection 27*a* of the bracket 27 are engaged with the bolts 28 to be vertically movable, respectively. Rollers 30 rotatably pivotally mounted on the sliding metal pieces 29 roll along the projections 27*a*, respectively.

Elevating chains 31 are hung at the rear portion of the apparatus from the horizontal members 20*a* of the left and right paper feed frames 20, respectively. The lower ends of the elevating chains 31 are fixed on the brackets 25, respectively. An elevating chain 33 is hung between a pair of chain guides 32 fixed on the end face of the front portion of each horizontal member 20*a*. One end of the elevating chain 33 is fixed at the upper end portion of the sliding metal piece 29. The other end of the elevating chain 33 is guided between chain guides (neither are shown) on the floor surface and fixed at the lower end portion of the sliding metal piece 29.

More specifically, two ends of the elevating chain 33 are coupled through the sliding metal piece 29 to form an endless chain. When the left and right elevating chains 31 and 33 at the front and rear portions are wound up or rewound in synchronism with each other by a driving unit 55 such as a motor, the left and right elevating bars 23 are vertically moved in synchronism with each other. Grooves 23*a* are formed in the lower surface of each elevating bar 32 at the front and rear portions, respectively. Inverted L-shaped brackets 34 are fixed in the grooves 23*a* by bolts 35, respectively. Two pairs of left and right rollers 36 corresponding to each of four corners of a lower iron plate 38 are pivotally mounted on a vertical member 34*a* extending below each bracket 34 to be rolled in a direction across to the feed direction.

Other inverted L-shaped brackets 37 each having a width larger than that of the bracket 34 are fixed in the grooves 23*a* of the elevating bars 23 with vertical members 37*a* supported by the rollers 36, respectively. The lower iron plate 38 serving as a rectangular lower iron plate is fixed at its four corners to the brackets 37 by bolts 39.

The lower iron plate 38 is vertically moved together with the elevating bars 23 through brackets 34 and 37 and the rollers 36. Since the brackets 37 integral with the lower iron plate 38 are supported by the rollers 36, the lower iron plate 38 is horizontally movable in a direction across to the feed direction as indicated by an arrow A in FIG. 1 or 2. Rollers 40 are pivotally mounted on brackets 41 fixed on the elevating bars 23 in correspondence with the four corners of the lower iron plate 38. The rollers 40 are in contact with vertical members 37*b* of the brackets 37 to freely move the lower iron plate 38 in the left and right directions while regulating the forward and backward movements of the lower iron plate 38.

As shogun in FIG. 1, a pin 42 vertically extends from the central portion of the lower iron plate having the above arrangement. Elongated holes 43 are formed at the four corner portions and the two central portions of the lower iron plate 38. A plurality of rollers are arranged in a line inside each elongated hole 43 to be free to roll in the feed direction while the upper ends are slightly kept exposed from the upper surface of the lower iron plate 38.

A rectangular plate-like sliding iron plate 45 serving as an upper iron plate is mounted on the lower iron plate 38, strictly speaking, on the plurality of rollers 44. The pin 42 is engaged with an elongated hole 45*a* formed in the central portion of the sliding iron plate 45. The sliding iron plate 45 is pivotally movable about the pin 42. At the same time, the sliding iron plate 45 is guided forward or and backward, i.e., in the feed direction to be free to move while rolling the rollers 44.

On the other hand, a plurality of front gauges 47, formed in a bar-like shape by plate members, for aligning paper sheets 46 stacked on the sliding iron plate 45, are vertically supported on the machine frame side. At the lower end portion of each front gauge 47, as shown in FIG. 2, a cam 48 having a cam surface comprising an inclined surface 48*a* inclined upward in a direction to be close to the front gauge 47 and a vertical surface 48*b* is fixed by bolts 49. A bar 51 serving as an engaging member supported through a bracket 50 in a notch 45*b* of the sliding iron plate 45 is in contact with the cam surface of the cam 48.

Spring hooks 52 are fixed on the left and right sides of the lower iron plate 38, and other spring hooks 53 are fixed on the left and right sides of the sliding iron plate 45. A pair of left and right tension coil springs 54 are interposed between the spring hooks 52 and the spring hooks 53, respectively, to press the sliding iron plate 45 and the paper sheets 46 against the front gauges 47 when the both iron plates 38 and 45 are moved upward, and bias the bars 51 in a direction to be pressed against the cam surfaces of the cams 48 when the both iron plate 38 and 45 are moved downward. Since the pair of left and right tension coil springs are provided, the paper sheets 46 on the sliding iron plate 45 are uniformly pressed against the front gauges 47.

An operation of the paper stacking apparatus having the above arrangement will be described. When the driving units 55 are operated to rewind the elevating chains 31 and 33 to move the elevating bars 23 downward, the brackets 34 integral with the elevating chains 23 are also moved downward. The lower iron plate 38 on which the sliding iron plate 45 is mounted is moved downward to the lower limit through the brackets 37 supported by the rollers 36 of the bracket 34. At this time, the bars 51 of the sliding iron plate 45 are pressed against the linear portions 48*b* of the cams 48 by the tensile forces of the tension coil springs 54. For this reason, the sliding iron plate 45 is separated from the front gauges 47.

The paper sheets 46 stacked on the paper stack plate by a paper stacking apparatus outside the machine frame are conveyed by a handlift or the like and mounted on the sliding iron plate 45. In this case, the end portions of the paper sheets 46 on the front gauge 47 side slightly protrude from the end portion of the sliding iron plate 45. More specifically, the paper sheets 46 are mounted on the sliding iron plate 45 such that the paper sheets 46 slightly protrude to the front gauge 47 side.

Thereafter, when the elevating chains 31 and 33 are wound up by the driving units 55, the lower iron plate 38 and the sliding iron plate 45 on which the paper sheets 46 are stacked are moved upward together with the elevating bars 23. The bars 51 are moved upward while being pressed against the inclined surfaces 48*a* of the cams 48 by the tensile forces of the tension coil springs 54. When the bars 51 are released upward from the inclined surfaces 48*a* of the cams 48, the tensile forces of the tension coil springs 54 act on the sliding iron plate 45 and the paper sheets 46 stacked thereon. The leading end faces of the paper sheets 46 protruding from the sliding iron plate 45 are pressed against the front gauges 47, thereby performing paper alignment.

During paper alignment, the sliding iron plate 45 on which the paper sheets 46 are stacked pivots about the pin 42, and at the same time, the respective portions of the leading ends of the paper sheets 46 are uniformly pressed against the front gauges 47, since the elongated hole 45*a* of the sliding iron plate 45 is engaged with the pin 42, and the tension coil springs 54 are provided to the left and right sides of the both iron plate 38 and 45, respectively. For this reason, even if the paper sheets are skewed on the sliding iron plate 45, the respective portions of the paper sheets 46 are uniformly pressed against the front gauges 47, and the paper sheets 46 are quickly and correctly aligned, because the sliding iron plate 45 is pulled by the tensile forces of the left and right tension coil springs 54 while rolling the rollers 44.

Since the brackets 37 integral with the lower iron plate 38 are supported by the rollers 36 of the elevating bars 23, the left and right positions of the paper sheets 46 can be smoothly adjusted by moving the sliding iron plate 45 and the paper sheets 46 through the lower iron plate 38 in the left and right directions. In this case, the lower iron plate 38 is moved by the driving units in the left and right directions to control the left and right positions of the paper sheets 46, thereby easily realizing an automatic paper stacking.

In this embodiment, an arrangement is exemplified in which the cams 48 are fixed at the lower end portions of the front gauges 47, and the bars 51 in contact with the cam surfaces of the cams 48 are provided to the sliding iron plate 45 side. However, the cam may be provided to the sliding iron plate 45, and the bars or the rollers may be provided to the front gauges 47. An only pair of the cam and the bar or the roller may be provided.

In addition, the rollers or cams may be provided to the lower side of the sliding iron plate 45 and the cams or rollers may be provided the floor surface. In this case, holes are formed in the lower iron plate, and the rollers or cams of the sliding iron plate 45 project below the lower iron plate 38.

Furthermore, although in this embodiment, the tension coil springs 54 are exemplified as spring members for pressing the paper sheets 46 against the front gauges 47, the positions of the spring hooks 52 and 53 may be changed to use compression coil springs.

As is apparent from the above description, according to the present invention, during paper alignment, the upper plate on which the paper sheets are stacked is smoothly moved in each horizontal direction to uniformly press the respective portions of the paper sheets against the front gauges and correctly align the paper sheets, thereby improving paper feed performance. In addition, even if the paper sheets are slightly skewed, the direction can be corrected within a short period of time during paper alignment. Therefore, the preparation time is shortened to improve the operation ratio of the printing press, and the operator load is reduced.

What is claimed is:

1. A paper stacking apparatus for a sheet-fed press, comprising:

a horizontal lower plate free to move in a vertical direction;

driving means for vertically moving said lower plate;

an upper plate, mounted on said lower plate to be movable in a paper feed direction and rotatable about an axis perpendicular to a surface of said upper plate, for stacking paper sheets;

a front gauge, vertically fixed on a machine frame, for aligning a leading end of the paper sheets stacking on said upper plate in the paper feed direction;

a pair of biasing members, provided at two side portions of said upper plate, having biasing forces for biasing said upper plate in a direction to be pressed to said front gauge;

a positioning member provided to be coupled with one of said upper plate and said front gauge, said positioning member having an inclined surface inclined in the paper feed direction in correspondence with an upward portion; and an engaging member provided to be coupled with the other of said upper plate and said front gauge and to be engaged with said positioning member, wherein a distal end of said upper plate is separated away from said front gauge in opposition to the biasing forces of said biasing members when said engaging member is engaged with a lower portion of said positioning member and comes closer to said front gauge by means of said biasing means in accordance with an upward movement of said lower plate.

2. An apparatus according to claim 1, wherein said positioning member comprises a cam member which is provided on said front gauge, said cam member having a cam surface inclined upward in a direction to be close to said front gauge, and said engaging member is provided at the distal end of said upper plate to be engaged with the cam surface of said cam member.

3. An apparatus according to claim 2, wherein said cam is provided to lower end portion of said front gauge, and an upper portion of said inclined surface of said cam continues to a vertical surface of said front gauge.

4. An apparatus according to claim 1, further comprising sliding means for freely moving said upper plate in the paper feed direction with respect to said lower plate.

5. An apparatus according to claim 4, wherein said sliding means comprises a plurality of rollers rolling in the paper feed direction and exposed from a plurality of holes formed in said lower plate above an upper surface of said lower plate, respectively, to support said upper plate.

6. An apparatus according to claim 1, further comprising a pin extending from a central portion of said lower plate, and an elongated hole formed in a central portion of said upper plate and engaged with said pin, and wherein said upper plate pivots about said pin and is guided by said elongated hole engaged with said pin to be movable in the paper feed direction.

7. An apparatus according to claim 1, further comprising a pair of elevating bars disposed along two side portions of said lower plate and each having two end portions vertically moved by said driving means, and holding means for holding said two side portions of said lower plate to be movable in a direction across to the paper feed direction, and wherein said lower plate is movable in the direction across to the paper feed direction and adjusts left and right positions of the paper sheets stacked on said upper plate.

8. An apparatus according to claim 7, wherein said holding means comprises first rollers axially horizontally supported on said elevating bars and rolling in the direction across to the paper feed direction, and inverted L-shaped support members, fixed to said two side portions of said lower plate, for supporting horizontal members on upper surfaces of said first rollers.

9. An apparatus according to claim 8, further comprising second rollers axially vertically supported on said elevating bars, in contact with said support members, and rolling in the direction across to the paper feed direction, and wherein said lower plate is moved in the direction across to the paper feed direction and inhibited to move in the paper feed direction by said second rollers.

10. An apparatus according to claim 1, wherein said front gauge comprises a plurality of plate members formed in a bar-like shape, and said plate members are arranged in parallel to the distal end of said upper plate.

11. A paper stacking apparatus for a sheet-fed press, comprising:

a horizontal lower plate free to move in a vertical direction;

driving means for vertically moving said lower plate;

an upper plate, mounted on said lower plate to be movable in at least a paper feed direction, for stacking paper sheets;

a front gauge, vertically fixed on a machine frame, for aligning a leading end of the paper sheets stacked on said upper plate in the paper feed direction;

biasing members for biasing two side portions of said upper plate in a direction to be pressed to said front gauge;

positioning means for positioning said upper plate biased by said biasing members in the paper feed direction such that a distal end thereof is closed to said front gauge in accordance with an upward movement of said lower plate; and a pin extending from a central portion of said lower plate, and an elongated hole formed in a central portion of said upper plate and engaged with said pin, and wherein said upper plate pivots about said pin and is guided by said elongated hole engaged with said pin to be movable in the paper feed direction.

* * * * *